US005096248A

United States Patent [19]

Ryan

[11] Patent Number: 5,096,248

[45] Date of Patent: Mar. 17, 1992

[54] BUNDLING HANDLE

[76] Inventor: Richard P. Ryan, 6372 Gondola Way, San Jose, Calif. 95120

[21] Appl. No.: 615,460

[22] Filed: Nov. 19, 1990

[51] Int. Cl.[5] ..... A45F 5/00

[52] U.S. Cl. ..... 294/156; 294/150; 294/165

[58] Field of Search ..... 294/156, 150, 151, 152, 294/153, 165, 74; 24/16 R, 16 PB, 17 R, 17 A, 17 B, 17 AP, 18

[56] References Cited

U.S. PATENT DOCUMENTS

| | | | |
|---|---|---|---|
| 1,824,027 | 9/1931 | Lundquist . | |
| 2,936,980 | 5/1960 | Rapata | 24/17 AP X |
| 3,098,315 | 7/1963 | Bono | 294/165 X |
| 3,143,266 | 8/1964 | Imatake | 24/17 A X |
| 3,167,344 | 1/1965 | Applegarth | 294/152 X |
| 3,378,222 | 4/1968 | Erickson . | |
| 3,493,154 | 2/1970 | Engle | 294/150 |
| 3,702,203 | 11/1972 | Oltmanns | 24/16 PB X |
| 3,834,824 | 9/1974 | Jahn | 24/16 PB X |
| 3,958,731 | 5/1976 | Riedle | 224/58 |
| 3,979,094 | 9/1976 | DeWitt | 24/16 PB X |
| 3,997,943 | 12/1976 | Jones et al. | 24/16 PB X |
| 4,059,302 | 11/1977 | Barthule | 294/74 |
| 4,277,035 | 7/1981 | Gaski | 242/85.9 |
| 4,558,896 | 12/1985 | Farnworth | 294/156 |
| 4,586,745 | 5/1986 | Shepard | 294/150 |
| 4,696,505 | 9/1987 | Shadoan | 294/153 |
| 4,991,536 | 2/1991 | Moshofsky | 24/16 PB X |

*Primary Examiner*—Margaret A. Focarino
*Assistant Examiner*—Dean J. Kramer

[57] ABSTRACT

A unit is provided where there is, included, a grip portion (8), a strap portion (11), and a buckle portion (14), which can be encircled around a load to facilitate bundling, carrying and storing of that load and can be attached to the load without having to set down that load. The unit will remain around load until removed because of the friction between the strap portion (11) and buckle portion (14). Unit may also be semi-permanently attached to a part of the said load so as to prevent the loss of the unit. For example: A person may insert a rope (62) through the dog bone slots (47) (50) to retain the unit when the unit is not being used to bundle said rope (62). A hole (29) is provided in strap portion (11) so unit may be hung on a nail or other protruding object. A flap (23) in the grip portion is also provided. This not only strengthens the grip portion (8), but also displaces the weight of the load throughout a persons hand (59). The unit is adjustable and a multitude of units may be coupled together by inserting the grip portion (8) of one unit into the buckle portion (14) of another unit to create one large unit.

5 Claims, 4 Drawing Sheets

BUNDLING HANDLE

BACKGROUND OF THE INVENTION

1. Field of the Invention

This invention is in the field of package and article carriers with handles and straps.

2. Description of the Prior Art

In the past, many loads had to be carried and by bundled hand. Extension cords, ropes, and pipes are examples. Then after being bundled by hands these loads would then have to be laid down so as an article carrying device may be brought forth and attached.

Various means have been proposed for providing packaging and handles for articles, such as shown in U.S. Pat. No. 4,696,505 to Shadoan. This device includes a handle and a strap to thread through that handle. It appears that it would be very difficult to hold a coiled rope or other bundled items with one hand and attach this device with the other.

Another bundle of this type is known from U.S. Pat. No. 3,958,731 to Riedle. This device includes a strap with a grip at one end and a handle with a slot to receive and latch said grip at the other end. The bight on this device is not adjustable and would not work well when bundling of articles is required.

Another handle of this type is known from U.S. Pat. No. 4,558,896 to Farnworth. This device includes grip attached to a slotted strap. At the free end of the strap is a tee bar, which when circled back to the strap or the grip, will form an adjustable bight. It is also very difficult to hold this device and coil a rope or other bundled items with one hand and attach this device with the other. This device also shows no means of attaching itself securely to an item such as an extension cord that is in use. This would prevent its loss when this device is not in use.

SUMMARY OF THE INVENTION

One embodiment of the present invention, there is provided a grip portion, a strap portion and a buckle portion.

The buckle portion having an opening large enough so it may be slipped over a persons wrist leaving that persons hands free of bundling, coiling or accumulating of articles. For example: A person may insert his right wrist through the buckle of embodiment, then coil a rope in his right hand. He would then, with his left hand, grab hold of the slot in the grip portion at the other end of the embodiment and encircle the rope, then insert the grip portion thought the opening in the buckle portion, then remove his right hand holding the embodiment's grip portion in his left hand. The strap portion of the embodiment is equal to or slightly wider across its horizontal plane than the opening in the buckle portion is across its horizontal plane. This will cause the sides of the strap and the sides of the opening in the buckle portion to become friction bearing surfaces and remain encircled around said rope, even if the grip portion is released.

The invention also provides a means of semi-permanent attaching a single strand of rope, cord, or a like to the said buckle portion. This will prevent the loss of the said embodiment when it is not in use.

The grip portion of the said embodiment includes a slot. Attached to the top of the slot is a flap. This flap is folded back when a hand is inserted into that slot. This not only strengthens the grip portion, but also displaces the weight of the load throughout that hand.

Within the strap portion, a hole has been punched. This may be used to hang the embodiment on a nail or other protruding object. This will prevent damage to the grip portion.

The grip portion of the said embodiment is larger across its horizontal plane than the rectangular opening of the buckle portion is across its horizontal plane. This is so a multitude of the said embodiments maybe coupled together, by inserting the grip portion of one of the said embodiment into the buckle portion of another of the said embodiment to create one large embodiment. Further objects and advantages of the present invention shall be apparent from the accompanying figures and detailed description.

Figure 1:
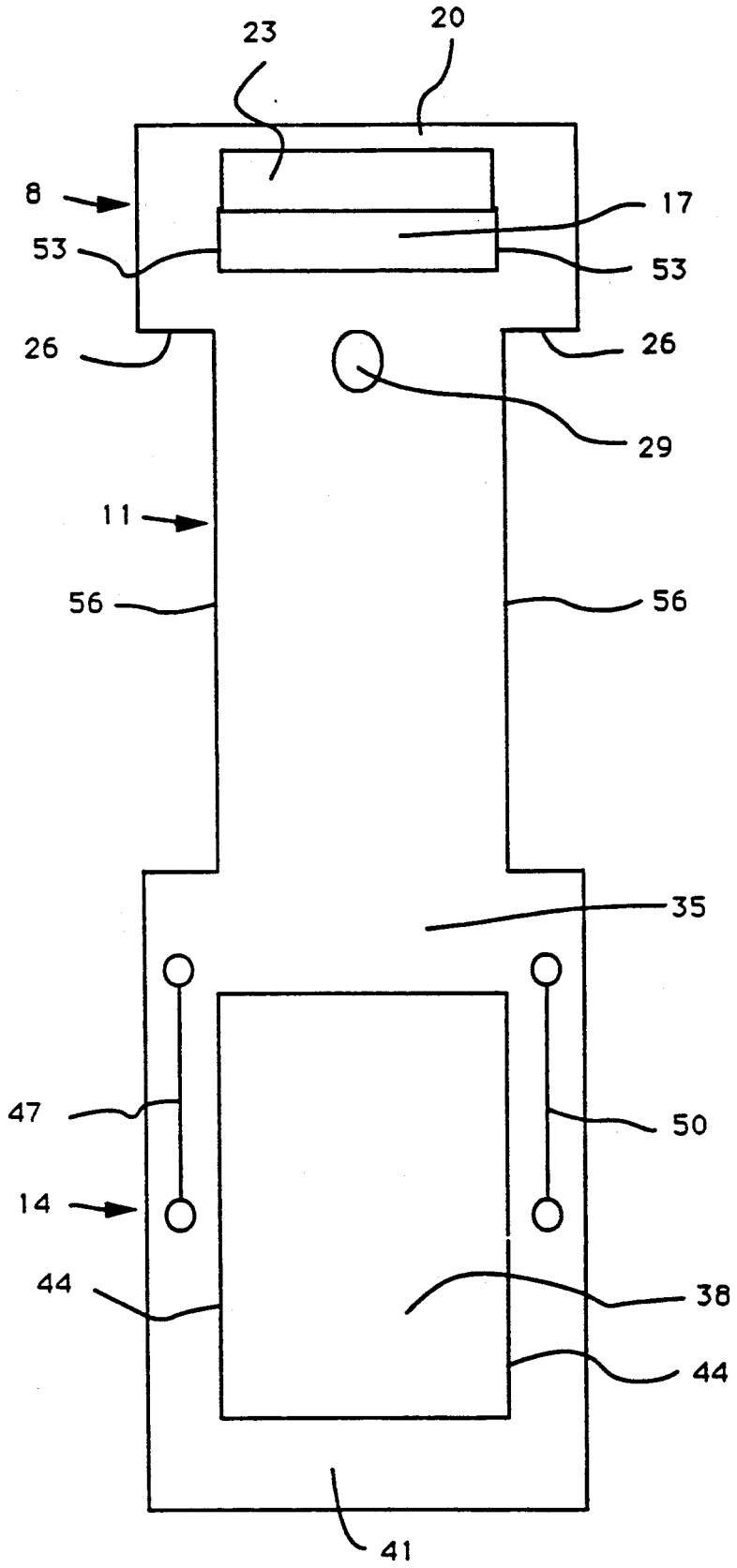
FIG. 1 is a front view of an embodiment of the present invention.

DRAWING REFERENCE NUMERALS:

8. Grip portion
11. Strap portion
14. Buckle portion
17. Slot
20. Upper bar
23. Flap
26. upper stop
29. Hole
35. Spreader bar
38. Rectangular opening
41. Lower bar
44. side of the rectangular opening 38
47. Left dog bone slot
50. Right dog bone slot
53. side of slot 17
56. side of strap portion 11
59. Hand
62. Rope

DESCRIPTION OF THE PREFERRED EMBODIMENT

For the purposes of promoting an understanding of the principles of the invention, reference will now be made to the embodiment illustrated in the drawings and specific language will be used to describe the same. It will nevertheless be understood that no limitation of the scope of the invention is thereby intended, such alternations and further modifications in the illustrated device, and such further applications of the principles of the invention as illustrated therein being contemplated as would normally occur to one skilled in the art to which the invention relates.

Figure 2:
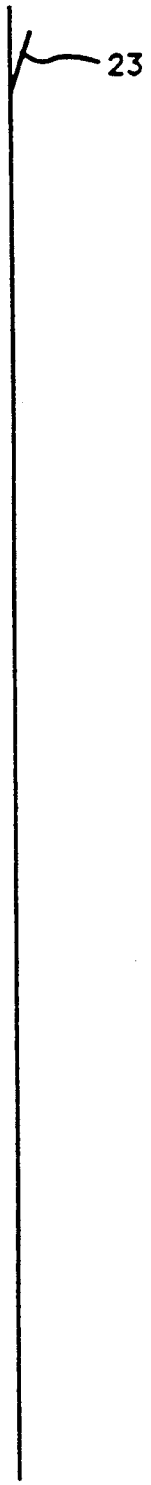
FIG. 2 is a side view of the embodiment of FIG. 1.

Referring in particular to FIG. 1 and FIG. 2, there is shown an embodiment of a bundling handle according to the present invention. Said embodiment can be made from a single piece of a flat bendable and twistable material which would include a grip portion 8, strap portion 11, and buckle portion 14.

The grip portion 8 has a slot 17 for inserting a persons hand. It also includes a flap 23 which is shown folded up. Folded up flap 23 will strengthen upper bar 20. The grip portion 8 will also include upper stops 26.

The strap portion 11 is equal to or slightly wider across its horizontal plane than rectangular opening 38 is across its horizontal plane. This will cause the side of strap 56 and the side of the rectangular opening 44 to become friction bearing surfaces when said embodiment is in use. Within strap portion 11 there is a hole 29 so as said embodiment may be hung on a small nail or protruding object without damage to the grip portion 8.

The buckle portion 14 includes a rectangular opening 38 in which grip portion 8 and strap portion 11 can inserted through. The buckle portion 14 also includes a spreader bar 35, lower bar 41, left dog bone slot 47, and a right dog bone slot 50.

Figure 3:
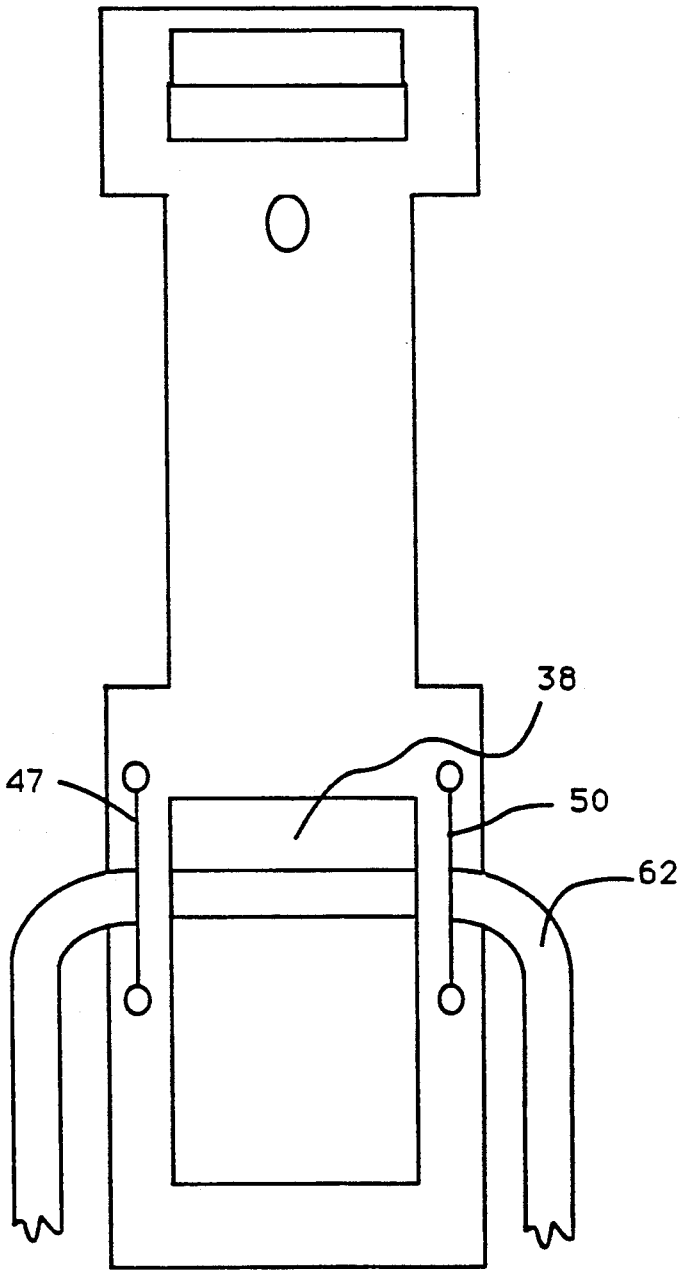
FIG. 3 is a front view of an embodiment of FIG. 1 with a rope threaded through the dog bone slots.

Shown in FIG. 3 of the drawings is said embodiment with a rope 62 threaded through left dog bone slot 47 across rectangular opening 38 and threaded through right dog bone slot 50. This prevents loss of said embodiment when it is not in use.

Figure 4:
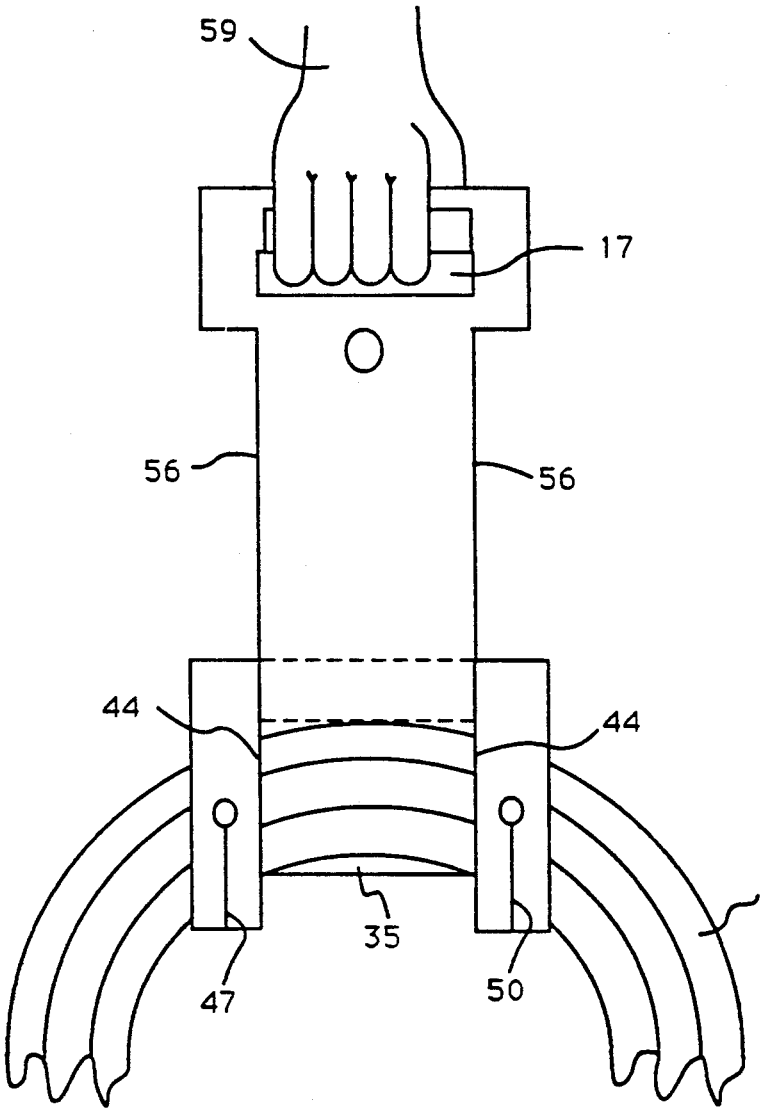
FIG. 4 shows the embodiment of FIG. 1 and FIG. 2 in carrying position encircling and holding a rope in place.
Figure 5:
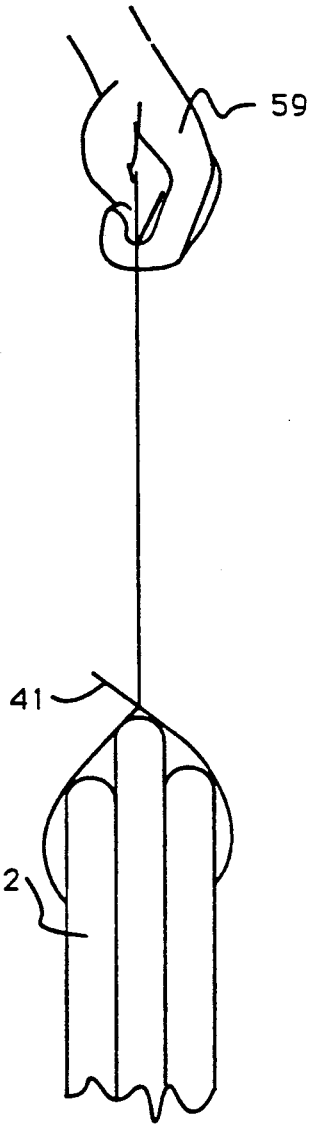
FIG. 5 is a side view of the combination shown in FIG. 4.

FIG. 4 and FIG. 5 of the drawings shows one use of said embodiment. Rope 62 has been coiled and grip portion 8 and strap portion 11 have been wrapped around said coil and inserted through rectangular opening 38, lower bar 41 is slid down against said coil to hold said coil in place. Friction between side of strap 56 and the side of the rectangular opening 44 will hold lower bar 41 tight against said coil. Hand 59 has been inserted into slot 17 so as said coil may be lifted. FIG. 4 and FIG. 5 of the drawings are shown without left dog bone slot 47 and right dog bone slot 50 in use.

Figure 6:
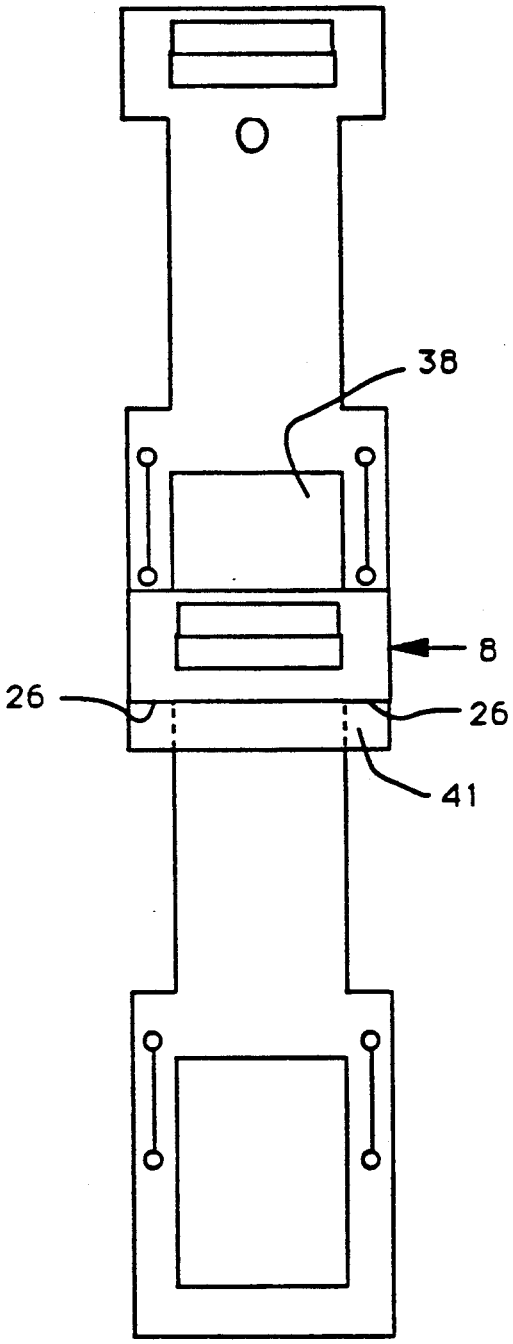
FIG. 6 is a front view of two of the said embodiments coupled together.

Shown in FIG. 6 two of the said embodiments have been coupled together by inserting the grip portion 8, of the second of the said embodiments through the rectangular opening 38, of the first of the said embodiments, so as the upper stop 26, of the second of the said embodiments, is resting on the lower bar 41, of the first of the said embodiments, thus making it possible to carry much larger loads.

What is claimed is:

1. Apparatus for hand-carrying an article, comprising:

A strap with a grip portion parallel to a strap portion permanently connected at one end and a buckle portion parallel to said strap portion permanently connected at the other end of said strap and whereas an opening in said buckle portion comprises parallel side edges and is of sufficient size so as a person may insert their hand through said buckle portion, and having said strap portion of sufficient width so as when the said grip portion and said strap portion are wrapped around a load and inserted through the said buckle portion there is friction between the outside edges of the said strap portion and the inside edges of the said opening of said buckle portion whereas said grip portion is larger in width than the opening in said buckle portion, in which friction remains constant throughout an adjustable range of said strap portion and said buckle portion and having said strap portion of sufficient length so as to allow said apparatus to be adjustable.

2. The apparatus of claim 1 in which the entire apparatus is constructed from a single piece of flat, bendable and twistable material.

3. The apparatus of claim 1 in which a hole is punched through an upper portion of the said strap large enough so as said apparatus may be hung upon a nail or other protruding object.

4. The apparatus of claim 1 in which a slot in said grip portion contains a flap which is attached to the top of said slot so as said flap will be folded back when a hand is inserted into said slot.

5. The apparatus of claim 1 in which includes a means of temporarily attaching a single strand of rope, cord, or a like, to the said buckle portion.

* * * * *